US005644894A

United States Patent [19]

Hudson

[11] Patent Number: 5,644,894

[45] Date of Patent: Jul. 8, 1997

[54] MULTI-SHEET GLAZING UNIT AND METHOD OF MAKING SAME

[75] Inventor: Joseph E. Hudson, Pittsburgh, Pa.

[73] Assignee: PPG Industries, Inc., Pittsburgh, Pa.

[21] Appl. No.: 326,580

[22] Filed: Oct. 20, 1994

[51] Int. Cl.[6] ..... E04C 2/54

[52] U.S. Cl. ..... 52/786.13; 52/786.11; 52/741.1

[58] Field of Search ..... 52/786.1, 786.11, 52/786.13, 741.1, 800.14

[56] References Cited

U.S. PATENT DOCUMENTS

| | | | |
|---|---|---|---|
| 2,525,727 | 10/1950 | Ottenheimer . | |
| 2,575,854 | 11/1951 | Verhagen . | |
| 2,688,824 | 9/1954 | Badger et al. | 52/786.1 X |
| 2,861,398 | 11/1958 | Woods | 52/786.1 X |
| 2,877,516 | 3/1959 | Bobel . | |
| 3,024,880 | 3/1962 | Burmeister | 52/786.1 X |
| 3,045,297 | 7/1962 | Ljungdahl . | |
| 3,837,129 | 9/1974 | Losell . | |
| 3,919,821 | 11/1975 | Goetz | 52/786.13 X |
| 4,149,348 | 4/1979 | Pyzewski . | |
| 4,170,460 | 10/1979 | Donley . | |
| 4,239,816 | 12/1980 | Breininger et al. . | |
| 4,335,166 | 6/1982 | Lizardo et al. . | |
| 4,368,226 | 1/1983 | Mucaria | 52/786.11 X |
| 4,411,115 | 10/1983 | Marzouki et al. | 52/786.13 X |
| 4,610,711 | 9/1986 | Matesa et al. . | |
| 4,719,127 | 1/1988 | Greenberg . | |
| 4,792,536 | 12/1988 | Pecoraro et al. . | |
| 4,806,220 | 2/1989 | Finley . | |
| 4,853,256 | 8/1989 | Obringer et al. . | |
| 4,853,257 | 8/1989 | Henery . | |
| 4,873,206 | 10/1989 | Jones . | |
| 5,007,217 | 4/1991 | Glover et al. | 52/786.13 X |
| 5,030,593 | 7/1991 | Heithoff . | |
| 5,240,886 | 8/1993 | Gulotta et al. . | |

*Primary Examiner*—Carl D. Friedman
*Assistant Examiner*—Aimee E. McTigue
*Attorney, Agent, or Firm*—Donald C. Lepiane

[57] ABSTRACT

A multi-sheet glazing unit has a pair of outer sheets spaced from one another and secured to a spacer frame. The spacer frame has a generally U-shaped cross section and raised portions on its base to define a recess. Peripheral and marginal edge portions of an intermediate sheet are positioned in the recess and held in position by the recess spaced from the outer sheets. A method of forming the unit is also disclosed.

13 Claims, 3 Drawing Sheets

MULTI-SHEET GLAZING UNIT AND METHOD OF MAKING SAME

FIELD OF THE INVENTION

This invention relates to a multi-sheet glazing unit, and, in particular to a multi-sheet thermal insulating glazing unit having a pair of outer glass sheets separated and secured to a spacer frame, the spacer frame having facilities to support in spaced relationship one or more glass sheets between and spaced from the outer glass sheets, and to a method of making the multi-sheet glazing unit.

BACKGROUND OF THE INVENTION

European Patent Application Publication Number 0 475 213 A1 published 18 Mar. 1992 Bulletin 92/12 (hereinafter "EP Application") based on U.S. patent applications Ser. Nos. 578,697 filed Sep. 4, 1990; 578,696 filed Sep. 4, 1990, and 686,956 filed Apr. 18, 1991, discloses a thermal insulating glazing unit having an edge assembly having low thermal conductivity and a method of making same. In general, The EP Application teaches a thermal insulating glazing unit having a pair of glass sheets about and sealed to an edge assembly to provide a sealed compartment between the sheets. The edge assembly includes a U-shaped spacer frame made of a material that is moisture and/or gas impervious, the spacer frame having a sealant on each of the outer surfaces of the upright legs of the spacer frame and an adhesive bead having desiccant therein adhered to inner surface of the spacer frame. The materials of the edge assembly are selected and sized to provide the edge assembly with a predetermined RES-value as defined and determined in accordance to the EP Application. The EP Application further discloses a thermal insulating glazing unit having three or more sheets with an edge assembly between each of the sheets.

U.S. patent application Ser. No. 08/102,596 filed Aug. 5, 1993, (hereinafter "U.S. Ser. No. 08/102,596") teaches a glazing unit or thermal insulating unit having one or more sheets spaced from and between a pair of outer sheets. In general, the unit includes the pair of outer glass sheets secured to outer legs of a spacer frame having a U-shaped cross section, e.g. of the type taught in the EP Application. On the base of the U-shaped spacer frame between the upright legs is a layer of a pliable material having a groove(s) for receiving edge portions of a sheet(s).

Although the glazing units disclosed in the EP Application and U.S. Ser. No. 08/102,596 are acceptable, it would be beneficial to have a method of manufacturing a glazing unit having three or more sheets that doesn't require providing an edge assembly between sheets as disclosed in the EP application or a groove(s) in a layer of pliable material to receive the edge of the intermediate sheet(s) as disclosed in U.S. Ser. No. 08/102,596.

U.S. Pat. No. 4,149,348 teaches a thermal insulating glazing unit having three or more sheets. In general, the unit includes a pair of outer glass sheets separated by a spacer-dehydrator element, or metal spacer having a generally rectangular cross sectional configuration and having a groove to maintain the intermediate sheet(s) between the pair of outer glass sheets.

Although the glazing unit taught in U.S. Pat. No. 4,149,348 is acceptable, there are limitations. More particularly, the spacer-dehydrator element containing desiccant is formed with a groove, and thereafter the spacer-dehydrator element has to be stored in a dry environment to prevent adsorption of moisture by the desiccant prior to its use. The use of the grooved metal spacer requires additional steps to form the spacer thereby increasing the fabrication cost of the glazing unit.

As can be appreciated, it would be advantageous to provide a glazing unit having three or more sheets and method of making same that supplements, and/or minimizes or eliminates the limitations and/or drawbacks, of presently known glazing units and methods of making them.

SUMMARY OF THE INVENTION

This invention relates to a glazing unit having three or more sheets (also referred to as a "multi-sheet glazing unit" or "multi-sheet unit"). The multi-sheet unit includes a spacer frame positioned between and secured to outer glass e.g. by an adhesive-sealant. The spacer frame has a base and may have upright legs providing the spacer frame with a U-shaped cross-sectional configuration. The base of the spacer frame has at least one recess facing the space between the outer sheets. At least one intermediate sheet is between the outer sheets with the peripheral and marginal edge portions of the intermediate sheet in the recess to secure the intermediate sheet in position within the spacer frame spaced from the outer sheets.

The invention also relates to a method of forming the multi-sheet glazing unit. The method includes providing a pair of outer sheets and an intermediate sheet. A spacer frame having a base shaped to provide a recess, the recess positioned about an intermediate sheet with peripheral and marginal edge portions of the intermediate sheet. The outer sheets are thereafter secured to the spacer frame to provide the multi-sheet glazing unit.

BRIEF DESCRIPTION OF THE INVENTION

The various embodiments of the multi-sheet unit of the instant invention will be discussed in the construction of a multi-sheet glazing unit that is a thermal insulating glazing unit having a low thermal conducting edge determined as disclosed in the EP Application which disclosure is hereby incorporated by reference. As will be appreciated, the instant invention is not limited to a multi-sheet glazing unit that is thermally insulating and/or has a low thermal conductive edge, and that the embodiments of the present invention may be used with a multi-sheet glazing unit regardless of its thermal insulating value. In the following discussion unless otherwise indicated like numerals refer to like elements.

Figure 1:
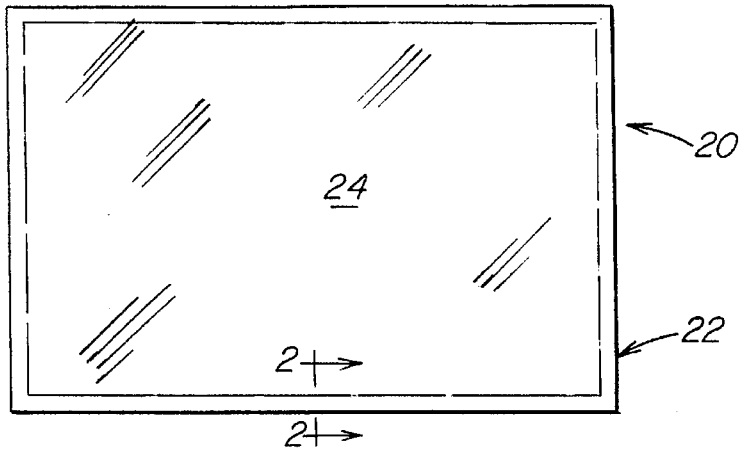
FIG. 1 is a front elevated view of a multi-sheet glazing unit incorporating features of the invention.
Figure 2:
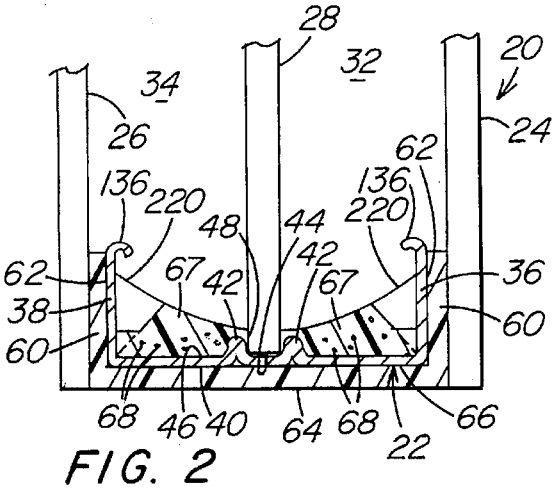
FIG. 2 is the view taken along lines 2—2 of FIG. 1 illustrating one embodiment of a spacer frame of the invention to space the outer sheets and retain the intermediate sheet in position between the outer sheets.

FIG. 1 shows a multi-sheet unit 20, and FIG. 2 shows a cross-sectional view of the multi-sheet unit 20 incorporating features of the invention. With specific reference to FIG. 2, the unit 20 includes a spacer frame 22 between a pair of outer sheets 24 and 26 and securing an intermediate sheet 28 in position in a manner to be discussed below to provide a compartment 32 between the sheets 24 and 28 and a compartment 34 between the sheets 26 and 28. Preferably but not limiting to the invention, the compartments 32 and 34 are sealed against the egress and ingress of gas e.g. air, moisture and/or or dust (hereinafter individually and collectively referred to as "environmental air") in a manner to be discussed below.

In the following discussion the sheets 24, 26 and 28 are glass sheets; however, as will become apparent, the sheets may be made of any material e.g. glass, plastic, metal and/or wood, and the selection of the materials is not limiting to the invention. Further, the sheets may be all of the same material or the sheets may be of different materials, and one sheet may be a monolithic sheet and the other(s) a laminated sheet e.g. made of one or more monolithic sheets laminated together in any convenient manner. Still further, one or more of the sheets and/or one or more of the surfaces of the sheet(s) may be coated e.g. glass or plastic transparent sheets may have an opaque coating of the type used in making spandrels or, an environmental coating to selectively pass predetermined wavelength ranges of light. U.S. Pat. Nos. 4,610,711; 4,806,220; 4,853,257; 4,170,460; 4,239,816 and 4,719,127 hereby incorporated by reference disclose coated sheets that may be used in the practice of the invention; however, as can now be appreciated, the instant invention is not limited thereto. One or more of the glass sheets may be coated and/or uncoated colored sheets for example but not limiting to the invention, colored sheets of the type disclosed in U.S. Pat. Nos. 4,873,206; 4,792,536; 5,030,593 and 5,240,886 which teachings are hereby incorporated by reference may be used in the practice of the invention.

The outer glass sheets 24 and 26 preferably have the same peripheral configuration and dimensions; however, as can be appreciated, one outer glass sheet may be larger than the other outer glass sheet, and one or more of the sheets 24, 26 and 28 may have different peripheral configurations than the remaining sheet(s).

Figure 3:
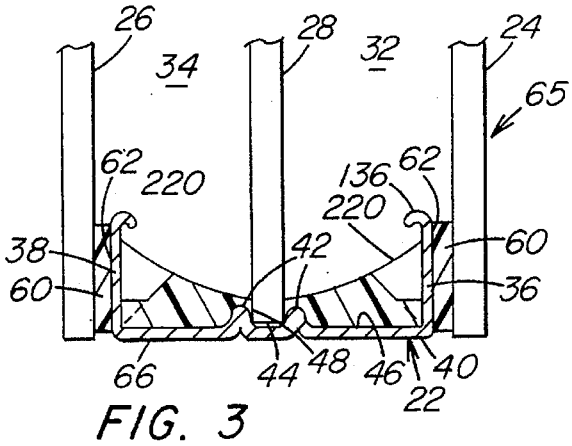
FIG. 3 is a view similar to the view in FIG. 2 illustrating another embodiment of a spacer frame of the instant invention.
Figure 7:
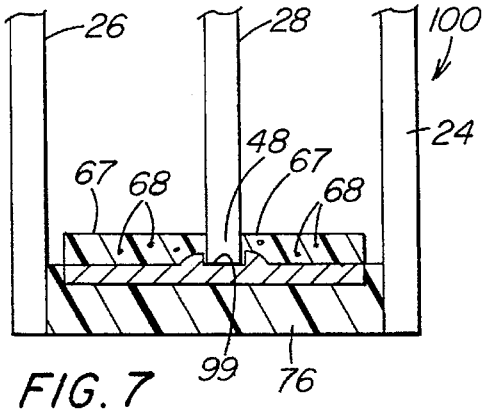
FIG. 7 is a view similar to the view of FIG. 2 illustrating the spacer frame shown in FIGS. 5 and 6 separating outer sheets.

Referring now to FIGS. 2 and 3, the spacer frame 22 has a generally U-shaped cross section defined by a pair of spaced outer legs 36 and 38 secured to a base 40. The base 40 is provided with spaced raised portions 42 to form a recess or groove 44 on inner surface 46 of the base 40 to receive peripheral edge portions 48 of the intermediate sheet 28 and engage marginal edge portions of the intermediate sheet 28 as shown in FIGS. 2 and 3 to limit or prevent movement of the intermediate sheet 28 toward and away from ones of the outer sheets. A layer 60 of a moisture impervious material e.g. an adhesive-sealant material of the type used in the art of making double glazed units having sealed compartments between the sheets is provided on outer surfaces 62 of outer legs 36 and 38 of the spacer frame 22 to secure the outer sheets 24 and 26 to outer legs 36 and 38 respectively of the spacer frame 22 to seal the compartments 32 and 34 against movement of environmental air into and out of the compartments.

With specific reference to FIG. 2 and although not limiting to the invention, a layer 64 of a sealant or adhesive-sealant may be provided over outer surface 66 of the base 40 of the spacer frame 22. The layer 64 may be a similar material as the material of the layer 60; however, it is preferred that the material of the layer 64 be non-tacky so that the units when stored or shipped on edge do not stick to the supporting surface. Further, units having the layer 64, have the spacer frame 22 preferably below the peripheral edges of the outer sheets 24 and 26 to provide a channel to receive the layer 64. The layer 64 may have a thickness of about 0.031 inch (0.08 cm) to about 0.50 inch (1.27 cm); preferably a thickness of about 0.150 inch (0.38 cm). Although not limiting to the invention the layer 64 may have similar moisture and gas resistance values as the layers 60. As can now be appreciated and with reference to FIG. 3, the instant invention may be practiced without the layer 64 as shown for unit 65 in FIG. 3.

The spacer frame of the instant invention may be made of any material e.g. wood, plastic, metal e.g. stainless steel, galvanized iron or tin coated steel, or aluminum having any cross sectional configuration to provide spaced raised portions forming a recess or groove to receive the peripheral edge portions 48 of the intermediate sheet 28 and engage the marginal edge portions of the intermediate sheet to limit or prevent movement of the intermediate sheet.

With specific reference to FIG. 2, a bead 67 is provided on the inner surface 46 of the base 40 of the spacer frame 22 for example but not limiting to the invention, after the raised portions 42 are formed and before the intermediate sheet 28 is positioned in the recess 44 in a manner to be discussed below. Although not limiting to the invention it is preferred to apply the bead 67 before positioning the peripheral and marginal edge portions of the intermediate sheet 28 in the recess 44 to prevent edge damage to the intermediate sheet. The bead 67 may be made of any material and preferably a moisture pervious material when desiccant 68 to keep the compartments 32 and 34 dry is carried by the bead 67. Since the raised portions 42 hold the intermediate sheet(s) in position, the bead 67 does not need to have structural stability. The bead may be of any material known in the art of insulated glazing units. Using a flowable material provides for ease of automating the positioning of the bead on the base and/or fabrication of the units. Materials that are most preferably used in the practice of the invention for the bead are those materials that are flowable and remain pliable after flowing e.g. of the type taught in the EP Application, and materials that are flowable and harden e.g. are dimensionally stable after flowing e.g. of the type taught in U.S. Ser. No. 08/102,596.

In the instance where the bead 67 has the desiccant 68 to keep the compartments dry, the bead, as discussed above, should be formed of a material that is moisture pervious. Although the invention is not limited thereto, materials having a permeability greater than 2 gm mm/$M^2$ day as determined by the procedure set out in ASTM F 372-73 are recommended in the practice of the invention. Such materials are disclosed in the EP Application and U.S. Ser. No. 08/102,546.

Figure 4:
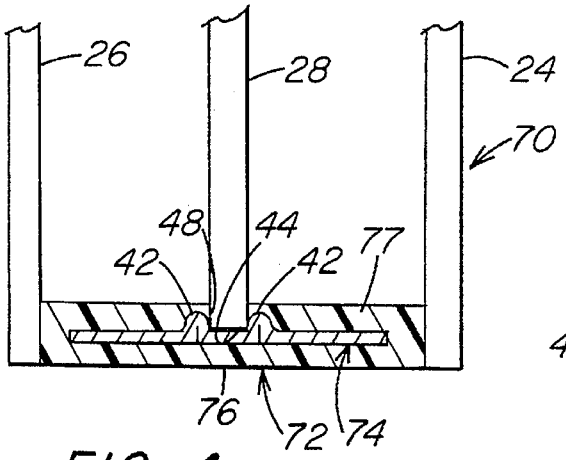
FIG. 4 is a view similar to the view of FIG. 2 illustrating still another embodiment of a spacer frame of the invention.
Figure 8:
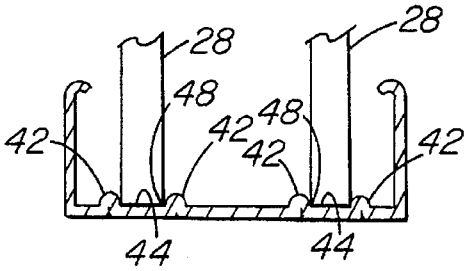
FIG. 8 is a cross sectional view of still another embodiment of a spacer frame of the invention to space outer sheets and to retain and space more than one intermediate sheet.

As can be appreciated, the peripheral dimensions and configuration of the spacer frame 22 are not limiting to the invention, and the spacer frame 22 may have any cross sectional configuration provided it has a recess to receive the peripheral and marginal edge portions of the intermediate glass sheet(s) 28 therebetween to limit or prevent movement of the intermediate sheet(s). For example and with reference to FIG. 4, there is shown a unit 70 having the outer sheets 24 and 26 separated by an edge assembly 72. The edge assembly 72 includes a spacer frame 74 having an outer adhesive-sealant layer 76 similar to the adhesive-sealant layer 64 shown in FIG. 2 to secure the outer sheets 24 and 26 to the spacer frame 74. The edge assembly 72 includes an inner layer 77. The inner layer 77 may be an adhesive-sealant similar to the material of the adhesive-sealant layer 76, may be a moisture pervious adhesive having a desiccant similar to the material of the bead 67 having the desiccant 68 shown in FIG. 2, or a combination of the materials of the layer 76 and bead 67 having the desiccant 68.

Figure 6:
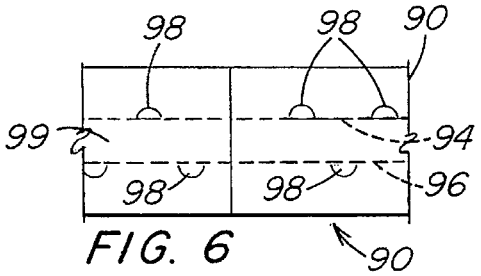
FIG. 6 is a plan fragmented view of the spacer shown in FIG. 5.
Figure 5:
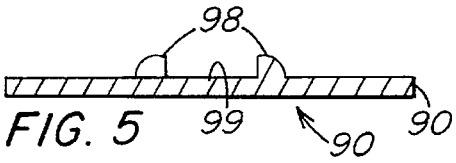
FIG. 5 is a cross sectional view of a spacer frame incorporating features of the invention to space outer sheets and to retain an intermediate sheet in position between the outer sheets.

With reference to FIGS. 5–8 there are shown additional embodiments of spacer frames and edge assembly that may be used in the practice of the invention. FIGS. 5 and 6 illustrate a spacer frame 90 having a base 99 and two predetermined rows 94 and 96 shown in dotted lines in FIG. 6 have spaced discreet elevated dimpled or raised portions 98 in each row, with the raised portions 98 in one row offset from the raised portions in the other row to form a retaining groove 99 to receive peripheral and marginal edge portions of the intermediate sheet 28 as shown for the multi-sheet glazing unit 100 shown in FIG. 7.

As can now be appreciated, the raised portions 42 and 98 may be formed in any manner e.g. by forming, swedging or securing material to the base of the spacer e.g. applying molten material or adhesive that solidifies and adheres to a substrate to form the raised portions. Further, as will be appreciated, the raised portions may be continuous or discreet spaced raised portions.

The invention is not limited to the number of intermediate sheets 28 in the multi-sheet glazing unit. For example and with reference to FIG. 8 there is shown spacer frame 110 similar to the spacer frame 30, but having a pair of recesses 42 formed on base 112 of the spacer frame 110 instead of one recess as shown for spacer frame 30 in FIG. 2. Each pair of the recesses 44 receive peripheral and marginal edge portions 48 of an intermediate sheet 28.

The spacer frames of the instant invention may be formed to have continuous corners e.g. of the type disclosed in the EPA Publication, or may be formed by joining ends of spacer sections by corner keys or welding as is known in the art of making insulating glazing units. As used in the discussion and in the claims, a continuous corner is defined as a corner that has portion(s) of the outer legs 36 and 38 (if the spacer frame has outer legs), and/or portions of the base e.g. base 40 continuous around the corner of the spacer frame and forming a portion or all of the corner.

As was previously discussed, the spacer frames of the instant invention may be made of any material and configuration provided the spacer frame provides structural stability to maintain the outer glass sheets 24 and 26 in spaced relationship to one another when biasing forces are applied to secure the glazing unit in a sash or a curtainwall system and to maintain the intermediate sheet(s) in position between the outer sheets. Although the spacer frames of the instant invention may be made of any material, it is preferred that the spacer frames have low thermal conductivity so that edge assembly which includes the spacer frame, the layers 60, layer 64 and bead 68 have a low thermal conductivity or high RES-value.

As can be appreciated, the spacer frame 22 should also be made of a material that is moisture and/or gas impervious such as but not limited to metal e.g. stainless steel, but includes halogenated polymeric material and/or spacers made of a gas pervious material and covered with an impervious film e.g. metal or polyvinylidene chloride film.

In regards to the edge assembly having a low thermal conductivity, spacer frames made of aluminum conduct heat better than spacer frames made of metal coated steels e.g. galvanized or tin plated steel, spacer frames made of metal coated carbon steels conduct heat better than spacer frames made of stainless steels, and spacer frames made of stainless steels conduct heat better than spacer frames made of plastics. Plastic provides better spacer frames from the standpoint of low thermal conductivity; however, metal is preferred for spacer frames because in many instances it is easier to shape and lends itself more easily to automation than plastic.

The EP Application discusses in detail the concept of edge assemblies having low thermal conductivity and how RES-value is determined. The following is a less detailed discussion but provides sufficient information for an appreciation of the concept.

The heat loss through an edge of a unit is a function of the thermal conductivity of the materials used, their physical arrangement, the thermal conductivity of the frame and surface film coefficient. Surface film coefficient is transfer of heat from air to glass at the warm side of the unit and heat transfer from glass to air on the cold side of the unit. The surface film coefficient depends on the weather and the environment. Since the weather and environment are controlled by nature and not by unit design, no further discussion is deemed necessary. The frame or sash effect is not relevant in the present discussion because the discussion is directed to the thermal conductivity of the materials at the unit edge and their physical arrangement.

The resistance of the edge of a unit to heat loss for an insulating unit having sheet material separated by an edge assembly is given by equation (1).

$$RHL=G_1+G_2+\ldots+G_n+S_1+S_2+\ldots+S_n \quad (1)$$

where RHL is the resistance to edge heat loss at the edge of the unit in hour—°F./BTU/inch of unit perimeter (Hr-°F./BTU-in.)

G is the resistance to heat loss of a sheet in Hr-°F./BTU-in.

S is the resistance to heat loss of the edge assembly in Hr-°F./BTU-in. For an insulating unit having two sheets separated by a single edge assembly equation (1) may be rewritten as equation (2).

$$RHL=G_1+G_2+S_1 \quad (2)$$

The thermal resistance of a material is given by equation (3).

$$R=L/kA \quad (3)$$

where R is the thermal resistance in Hr-°F./BTU-in.

k is thermal conductivity of the material in BTU/hour-inch-°F.

l is the thickness of the material as measured in inches along an axis parallel to the heat flow.

A is the area of the material as measured in square inches along an axis transverse to the heat flow.

The thermal resistance for components of an edge assembly that lie in a line substantially perpendicular or normal to the major surface of the unit is determined by equation (4).

$$S=R_1+R_2+\ldots+R_n \quad (4)$$

where S and R are as previously defined.

In those instances where the components of an edge assembly lie along an axis parallel to the major surface of the unit, the thermal resistance (S) is defined by the following equation (5).

$$R=\frac{1}{\frac{1}{R_1}+\frac{1}{R_2}+\ldots+\frac{1}{R_n}} \quad (5)$$

where R is as previously defined.

Combining equations (2), (4) and (5), the resistance of the edge of the unit 20 shown in FIG. 2 to heat flow may be determined by following equation (6).

$$RHL=R_{24}+R_{26}+2R60+2R_{36}+\frac{1}{\frac{1}{R_{40}}+\frac{1}{R67}+\frac{1}{R6_4}} \quad (6)$$

where RHL is as previously defined, $R_{24}$ and $R_{26}$ are the thermal resistance of the outer glass sheets, $R_{60}$ is the thermal resistance of the adhesive-sealant layers 60, $R_{64}$ is the thermal resistance of the adhesive layer 64, $R_{36}$ is the thermal resistance of the outer legs 36 and 38 of the spacer frame 22, $R_{40}$ is the thermal resistance of the base 40 of the spacer frame 22 and $R_{67}$ is the thermal resistance of the bead 67.

For ease of discussion, equation (6) does not consider the thermal conducting contribution of the intermediate sheet 28. If the thermal conductivity contribution of the intermediate sheet 26 were considered, it is expected that the value of RHL in equation (6) would be about 10% higher than the value calculated without considering the contribution of the thermal conductivity of the intermediate sheet 26.

Although equation (6) shows the relationship of the components to determine edge resistance to heat loss, Equation 6 is an approximate method used in standard engineering calculations. Computer programs are available which solve the exact relations governing heat flow or resistance to heat flow through the edge of the unit.

One computer program that is available is the thermal analysis package of the ANSYS program available from Swanson Analysis Systems Inc. of Houston, Pa. The discussion of the edge resistance of the edge assembly (excluding the outer glass sheets) will now be considered. The edge resistance of the edge assembly is defined by the inverse of the flow of heat that occurs from the interface of the glass sheet 24 and adjacent sealant layer 60 at the inside side of the unit to the interface of glass sheet 26 and adjacent adhesive-sealant layer 60 at the outside side of the unit per unit increment of temperature, per unit length of edge assembly perimeter (including the intermediate sheet). The outer glass sealant interfaces are assumed to be isothermal to simplify the discussion. Support for the above position may be found, among other places, in the paper entitled Thermal Resistance Measurements of Glazing System Edge-Seals and Seal Materials Using a Guarded Heater Plate Apparatus written by J. L. Wright and H. F. Sullivan ASHRAE TRANSACTIONS 1989, V.95, Pt.2.

In the discussion of the instant invention and in the claims, RES-value is defined as the resistance to heat flow of the edge assembly e.g. the edge assembly 22 in FIG. 2, per unit length of perimeter.

For a low thermal conducting edge of a multi-sheet unit of the instant invention a RES-value of at least about 10 is acceptable, a value of at least about 50 is preferred and a RES-value of at least about 100 more preferred.

Although not limiting to the invention it is preferred that the layer 60 of the adhesive-sealant that secures the outer sheets to the spacer frame 22 provides a long path to resist the movement of environmental air into and out of the compartment. Although the invention is not limited to the spacer frame design, it is preferred in the practice of the invention to use a spacer frame having outer legs e.g. of the type shown in FIGS. 2 and 8 to define the forming path by the outer legs of the spacer frame and the marginal edge portions of the outer sheets. It can now be appreciated that the materials of the layer 60 and the layer 64 are not limiting to the invention and are preferably a material that is gas and/or moisture impervious to prevent the ingress of environmental air into the compartment between the sheets. Materials that may be used in the practice of the invention include, but are limited to, butyl hot melts of the type sold as H. B. Fuller 1191.

Units filled with an insulating gas e.g. Argon preferably have the adhesive-sealant layer 60 and the layer 64 of a moisture and/or gas impervious material to maintain the insulating gas in the compartments 32 and 34. It is recommended that the adhesive-sealant layer 60 be thin and long to reduce the diffusion of the insulating gas out of the compartments of the unit or the environmental gas moving into the compartments of the unit. More particularly, increasing the thickness of the layer 60 i.e. the distance between the glass sheet and the adjacent outer leg of the spacer frame while keeping all other conditions constant increases the diffusion rate, and increasing the length of the layer 60 i.e. the distance between the top of the outer leg of the spacer frame and the base of the spacer frame while keeping all other conditions constant decreases the diffusion rate of gas through the adhesive-sealant layer 60. The invention may be practiced with the adhesive-sealant layer 60 having a thickness of about 0.005 inch (0.013 cm) to about 0.125 inch (0.32 cm), preferably about 0.010 inch (0.025 cm) to about 0.020 inch (0.050 cm) and more preferably about 0.015 inch (0.38 cm), and the layer 60 having a length of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

As can be appreciated the thickness and length of the layer 60 may change as the moisture and/or gas resistance value of the moisture and/or gas impervious material of the layer 60 changes. For example, as the resistance value of the material of the layer 60 increases, the thickness of the layer 60 may be increased and the length of the layer 60 may be decreased. As the resistance value of the material of the layer 60 decreases, the thickness of the layer 60 is preferably decreased and the length of the layer 60 is preferably increased. Adhesive-sealants that may be used in the practice of the invention include but are not limited to butyls, silicons, polyurethane adhesives, and preferably are butyls and polyurethanes such as H. B. Fuller 1191, H. B. Fuller 1081A and PPG Industries, Inc. 4442 butyl sealant.

With respect to the loss of the fill gas e.g. an insulating gas such as Argon from the unit, in practice the thickness and length of the layer 60 are chosen in combination with the gas permeability of the material so that the rate of loss of the fill gas matches the desired unit performance lifetime. The ability of the unit to contain the fill gas is measured using a European procedure identified as DIN 52293. Preferably, the rate of loss of the fill gas should be less than 5% per year and, more preferably, it should be less than 1% per year.

The material for the layer 60 preferably has a moisture permeability of less than 20 gm mm/$M^2$ day, and more preferably less than 5 gm mm/$M^2$ day, determined using the procedure of ASTM F 372-73.

In the following discussion techniques will be discussed to form a spacer frame of the instant invention having raised portions 42 on the base 40 of the spacer frame 22 to provide the recess 44 to receive the peripheral and marginal edge portions 48 of the intermediate sheet(s) 28; however, as will be appreciated by those skilled in the art the invention is not limited thereto and other techniques to provide a recess on the base of the spacer frame are within the contemplation of the instant invention.

Figure 9:
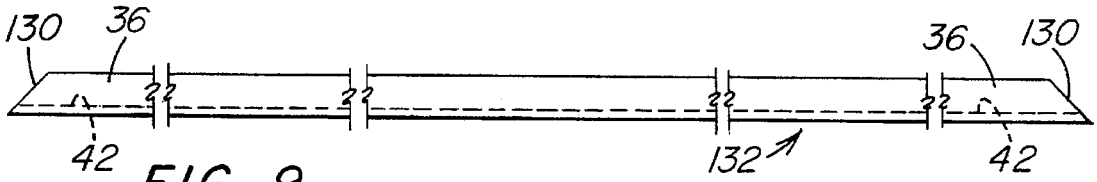
FIG. 9 is a side elevated view of a spacer section used to make a spacer frame incorporating features of the instant invention.

With reference to FIG. 9, one technique to form a spacer frame of the instant invention is to join ends 130 of spacer sections 132 (only one shown in FIG. 9) in any convenient manner e.g. the ends of the spacer sections 132 may be welded together, joined by corner keys or held together by an adhesive. As can be appreciated by those skilled in the art, to form a parallelepiped shaped spacer frame, 4 spacer sections have their ends joined together; to form a pentagonal shaped spacer frame, 5 spacer sections have their ends joined together, etc.

Figure 10:
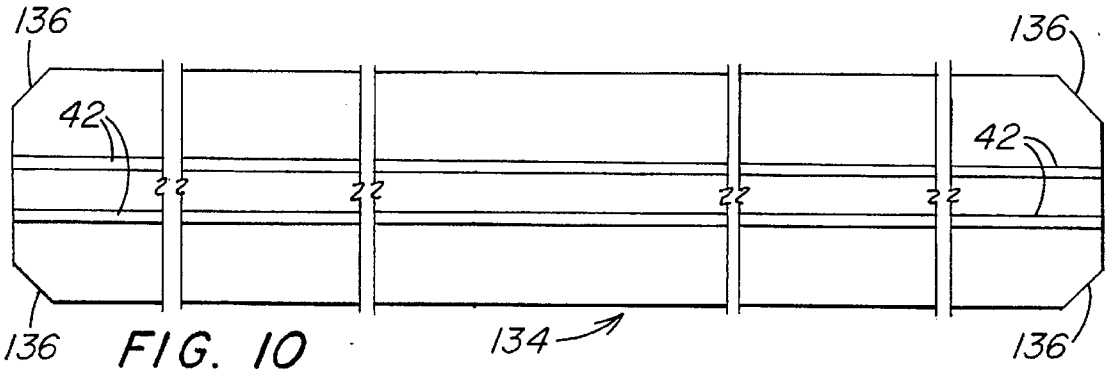
FIG. 10 is a plan view of a strip partially formed which is subsequently formed to provide the spacer section of FIG. 9.

The discussion will now be directed to forming the spacer section 132 have its ends 130 angled or mitered so that when the ends 130 of spacer sections 132 are joined together a closed spacer frame is formed e.g. for a parallelepiped spacer frame the corners 130 have a 45° slope, for a pentagonal shaped spacer frame the corners 130 have a 26° angle. Although not limiting to the invention and with reference to FIGS. 9 and 10, one technique for forming the spacer section 130 is to shape a flat strip 134 having angled corners 136 so that when the strip 134 is shaped into a spacer section 132 having a U-shaped cross section as shown in FIGS. 2 and 3, the corners 130 are mitered as shown in FIG. 9. The strip 134 is shaped e.g. roll formed to provide raised portion 42. The height of the raised portions 42 is not limiting to the invention; however, they should be of sufficient height to limit or prevent movement of the intermediate sheet 28 when the spacer frame is mounted above the intermediate sheet 28. The height of the raised portions are preferably between about 1/32 inch (0.080 centimeter) to about 1/8 inch (0.318 centimeter). After the raised portions 42 are formed in any convenient manner, the strip 134 is further shaped in any convenient manner to have a U-shaped cross section (see FIGS. 2 and 3) having mitered corners (see FIG. 9). As shown in FIG. 2, although not limiting to the invention, ends 136 of the outer legs 36 and 38 of the spacer frame 22 are bent toward one another to reduce flexing of the spacer section 132. As can now be appreciated by those skilled in the art of metal forming, the raised portion 42, outer legs 36 and 38 and ends 138 of the outer legs may be formed simultaneously on in any sequence.

Another technique for making a spacer frame incorporating features of the instant invention is to shape one spacer section of sufficient length to provide a spacer frame having continuous corners. Spacer frames having continuous corners are disclosed in the EP Application and in U.S. Ser. No. 08/102,596.

The invention will be discussed to make a glazing unit similar to the unit 20 shown in FIGS. 1 and 2 having a spacer frame having continuous corners. Each of the outer sheets 24 and 26 are clear glass sheets having a length of about 42⅞ inches (108.9 centimeter, hereinafter "cm") and a width of about 19¾ inches (50.17 cm). The intermediate sheet 28 is a clear glass sheet having a length of about 42½ inches (107.95 cm) and a width of about 19⅜ inches (49.2 cm). All the sheets have a thickness of 0.090 inch (0.229 centimeter).

The glass sheets 24 and 26 are each coated and are of the type sold by PPG Industries under its registered trademark Sungate® 100 coated glass. The coated surface of each of the sheets 24 and 26 faces the intermediate sheet 28.

Figure 11:
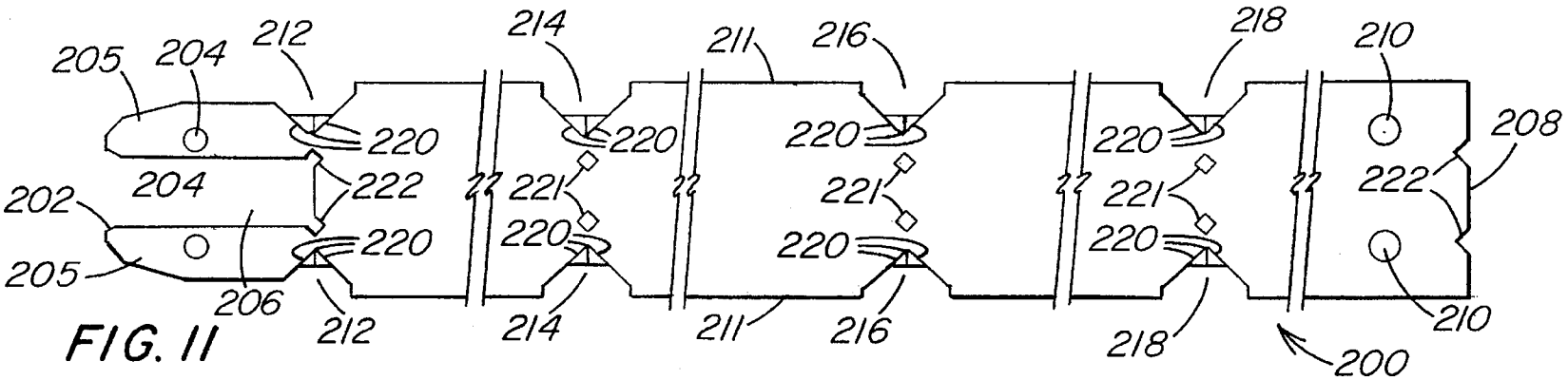
FIG. 11 is a plan view of a strip prior to shaping to form a recess in accordance to the invention and prior to shaping the strip to have the U-shaped cross sectional configuration shown in FIG. 2.

A spacer frame having four continuous corners is made as follows. A flat tin coated steel strip 200 having a length of about 126 inches (320 cm), a width of about 1.65 inches (4.191 cm) and thickness of about 0.010 inch (0.25 mm) is die cut. After die cutting the strip 200 as shown in FIG. 11 has a tapered and wedged bifurcated end 202 having a pair of holes 204 in the members 205 of the bifurcated end 202. Groove 206 found by the member 205 of the bifurcated end 205 has a width of about 0.720 inch (1.83 cm) and a length of about 1.5 inches (3.81 cm). Opposite end 208 of the strip 200 has a pair of holes 210 and receives the members 205 of the bifurcated end 202 when the spacer frame is positioned around the intermediate sheet 28. Spaced at locations about 1.5 inches (3.8 cm), about 21⅛ inches (53.65 cm), about 63⅞ inches (162.24 cm), and about 83½ inches (212.09 cm) from the end 202, material is removed from opposite edge portions 211 of the substrate 200 to provide sets of pair of notches 212, 214, 216 and 218 respectively. The notched areas form the bent portions 220 (see FIGS. 2 and 3), and the notches provide for the bent portions to be a sufficient distance so as to receive the intermediate sheet 28 in the recess 44. Crease lines 222 are provided at the notches as shown in FIG. 11 for ease of bending the bent portions.

Figure 13:
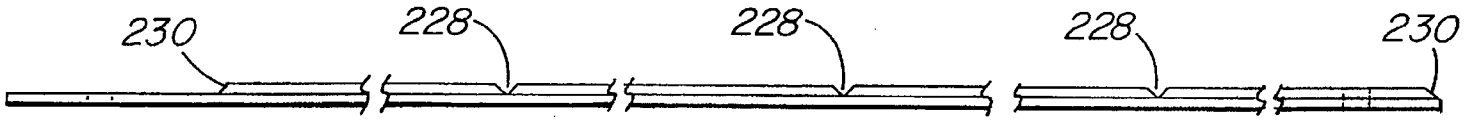
FIG. 13 is a side elevated view of the strip shown in FIG. 12.

Each of the notches of the set of pair of notches 214, 216 and 218 have a length of about 0.536 inch (1.36 cm) at the edge 211 of the substrate, a depth of about 0.170 inch (0.43 cm) as measured from the edge 211 of the substrate toward the center of the substrate. The notches 212 are similar in size as the notches 214, 216 and 218 but the left side of the notch as shown in FIG. 11 is further cut to insert the bifurcated members 205 of the end 202 into the end 208 after the strip 200 is formed to have a U-shaped cross section. The distance between the points of pairs of notches depends on the width of the base i.e. the desired spacing between the outer sheets. The unit has the point of the crease lines spaced about 0.282 inch (0.71 cm) from the edge 211 of the substrate to provide the base with a width of about 0.95 inch (2.42 cm) after the raised portions are formed and a width of about 1.7 inches (4.422 centimeters) before the raised portions are formed. Between the pair of notches where the raised portions are to be formed are shaped holes 220 and at the end 208 of the strip 200 cutouts 222. The holes 221 and cutouts 222 are sized such that after the continuous raised portions 42 are formed and the spacer frame formed to have the U-shaped cross section the continuous ridges at the corner are mitered as shown in FIG. 13 to form the continuous corner of the spacer frame.

The bifurcated members 205 of the end 202 are inserted in the space between the continuous raised portions 42 and the adjacent outer legs of the spacer frame 22.

Figure 12:
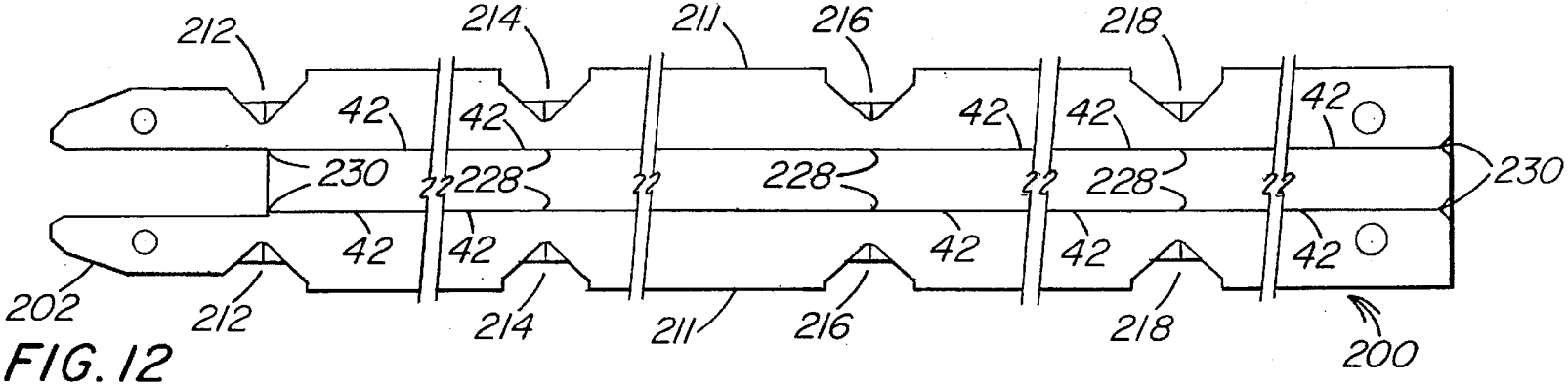
FIG. 12 is a view of the strip shown in FIG. 11 after being formed to provide raised portions in accordance to the invention.

After the substrate 62 is shaped to have the notches 212, 214, 216 and 218, crease lines 220, holes 221 and 222 and bifurcated member 205, the substrate is shaped in any convenient manner to provide the strip with the raised portions 42 defining the recess 44, the recess having a width of about 0.10 inch (0.254 cm). With reference to FIGS. 12 and 13, the holes 221 and 222 as shown in FIG. 13 appear V-shaped cut outs 228 and mitered ends 230 respectively in the raised portion. The strip 200 is further shaped to provide a spacer section having the U-shaped cross section shown in FIGS. 2 and 3. After the substrate is shaped, the bead 67 having the desiccant 68 is provided by extruding H. B. Fuller HL-5102-X-125 butyl hot melt matrix having the desiccant 68 therein onto the inner surface 40 of the base 40.

The adhesive-sealant layers 60 are extruded onto the outer surface 62 of the outer legs 36 and 38. The adhesive-sealant of the layer 60 may be of the type sold as H. B. Fuller 1191 hot melt butyl. The layers 60 has a thickness of about 0.020 inches (0.05 cm) and a height of about 0.300 inch (0.76 cm).

As can be appreciated, the bead having the desiccant may be extruded onto the base of the spacer before, after, or during the extrusion of the layers 60 onto the side of the spacer and the layer 60 may be applied to the outer surface of the legs during or after the strip is formed into spacer stock.

The intermediate sheet 26 is positioned through the bead into the recess 44 between notches 214 and 216. The spacer section between the pair of notches 216 and 218 is bent to position the recess 44 about the peripheral and marginal edge portions of the intermediate sheet; the spacer section between the pair of notches 218 and the end 230 is bent to position the peripheral edge portion of the intermediate sheet in the recess 44. The tapered end 202 is bent to a 90° angle, and the spacer stock is bent to position the recess 44 between the end 202 and notch 212 about the peripheral and marginal edge portions of the intermediate sheet. The tapered members 205 of the bifurcated end 202 are telescoped into the end 208 of the spacer stock to form the spacer frame.

The holes 204 and 210 are aligned with each after the spacer frame is positioned about the intermediate sheet. Thereafter the holes may be sealed with polyol polyisobutylene and sealed over with the adhesive layer 64. In the practice of the invention, it is recommended that a close end rivet be used to secure the ends of the spacer frame together. In this case the polyol polyisobutylene is not required to seal the compartment.

The outer glass sheets 24 and 26 are thereafter positioned over the sealant-adhesive layer 60 and biased toward one another to flow the sealant-adhesive layer 60 to secure the outer glass sheets to the spacer frame. Thereafter the sealant-adhesive 64 is flowed into the channel formed by the marginal edge portions of the sheets and the base 40 of the spacer frame.

Figure 14:
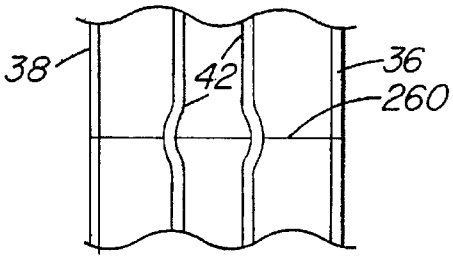
FIG. 14 is a fragmented view of a corner of a spacer frame incorporating features of the invention showing raised portions forming a recess spaced from one another.
Figure 15:
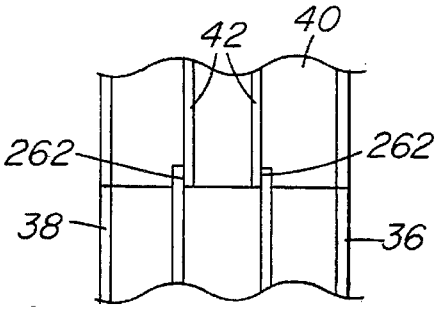
FIG. 15 is a fragmented view of a corner of a spacer frame incorporating features of the invention showing raised portions overlapping at the corner.

As can now be appreciated the invention is not limited to the embodiment of the glazing unit discussed above, and additional embodiments can be generated within the scope of the invention. For example instead of providing the holes 221 and cutouts 222 shown in FIG. 11 to provide the raised portion with mitered ends, the holes 221 and cutouts 222 may be eliminated and the raised portion 42 at the corner 260 biased away from one another as shown in FIG. 14 or the excess material of the raised portions overlap one another as shown by numerals 262 at the corners 260 after the spacer frame is formed as shown in FIG. 15.

What is claimed is:

1. A glazing unit comprising:

a pair of outer sheets defined as a first sheet and a second sheet, each of the first and second sheets having a major surface and a marginal edge portion on the major surface;

a spacer frame having at least two sides and a corner therebetween, the spacer frame having a pair of upright legs and a base between and connecting the upright legs to one another to provide a generally U-shape cross section, portions of the base defined as a first base portion and other portions of the base defined as a second base portion with the second base portion having an elevation different than the first base portion and extending between the upright legs, wherein the first base portion of the base extending along each of the at least two sides and at the corner is unitary and continuous, and the second base portion of the base extending along each of the at least two sides is unitary and continuous and separated at the corner by a separation that extends through a thickness of the base, and means for securing the marginal edge portions of the first sheet to an outer surface of one of the upright legs and marginal edge portions of the second sheet to an outer surface of the other one of the upright legs to space the first and second sheets from one another.

2. The unit as set forth in claim 1 wherein the spacer frame has a parallelepiped shape having opposed sides which includes the at least two sides and four corners which includes the corner between the at least two sides, the first base portion lies in a plane and the second base portion extends out of the plane between the upright legs and includes a first raised section along each of the at least two sides of the spacer frame and second raised section alone each of the at least two sides of the spacer frame, the first and second raised sections spaced from one another to provide a recess therebetween, and parallel to one another and the upright legs.

3. The unit as set forth in claim 2 wherein the first and second raised sections are continuous along each of the at least two sides of the spacer frame and further including first and second sections along each of the remaining sides of the spacer frame.

4. The unit of claim 3 wherein the means for securing the marginal edges of the pair of outer sheets to their respective outer surface of the upright legs of the spacer frame is a sealant, and further including a sheet in the recess formed by the first and second raised sections.

5. The unit of claim 4 wherein portions of the upright legs are bent toward one another over the base spaced from the sheet in the recess between the first and second raised sections.

6. The unit of claim 5 further including a moisture pervious adhesive having a desiccant therein on the first base portion.

7. The unit of claim 6 wherein the pair of sheets and the sheet in the recess between the first and second raised sections are glass sheets.

8. A multi-sheet glazing unit comprising:

a pair of outer sheets;

a spacer frame between the outer sheets, the spacer frame having a pair of upright legs having a base therebetween, the base shaped to provide a plurality of spaced raised portions along a first imaginary line and a plurality of spaced raised portions along a second imaginary line, the first and second lines spaced from one another to provide a recess therebetween, and parallel to one another and the upright legs;

means for securing the outer sheets to an outer surface of the upright legs of the spacer frame, and at least one sheet having peripheral and opposed marginal edges defined as an intermediate sheet between the pair of outer sheets with the peripheral and the marginal edge portions of the intermediate sheet in the recess to secure the intermediate sheet in position within the spacer frame spaced from the outer sheets.

9. The unit as set forth in claim 8 wherein the raised portions along the first imaginary lines are offset from the raised portions along the second imaginary line.

10. The unit of claim 8 wherein portions of the upright legs at the corners are bent toward one another over the base spaced from the intermediate sheet.

11. A method of forming a glazing unit comprising the steps of:

shaping a flat substrate to have a plurality of pairs of holes in the substrate between opposed edges of the substrate and at expected corners of a spacer frame to be formed;

shaping the substrate to provide a base joined to a pair of upright legs and a pair of spaced raised portions having a recess therebetween, the raised portions having generally sloped ends at expected corners of the spacer frame to be formed and to decrease the opening of the holes;

bending the spacer stock to form a spacer frame having corners; and securing outer sheets to the spacer frame.

12. The method of claim 11 further including the step of positioning edges of an intermediate sheet in the recess between the raised sections.

13. The method of claim 12 wherein said shaping step includes providing a plurality of pair of weaking lines at expected corners of the spacer frame, said shaping step includes shaping the strip to provide the weaking lines in the upright legs and said bending step includes moving portions of the upright legs between the weaking lines toward one another over the base.

* * * * *

UNITED STATES PATENT AND TRADEMARK OFFICE

CERTIFICATE OF CORRECTION

PATENT NO. : 5,644,894

DATED : July 8, 1997

INVENTOR(S) : Joseph E. Hudson

It is certified that error appears in the above-indentified patent and that said Letters Patent is hereby corrected as shown below:

Claim 2, line 8, delete "alone" and insert --along--.

Signed and Sealed this

Thirtieth Day of December, 1997

*Attest:*

*Attesting Officer*

BRUCE LEHMAN

*Commissioner of Patents and Trademarks*